US006915789B2

(12) United States Patent
Ratner et al.

(10) Patent No.: US 6,915,789 B2
(45) Date of Patent: Jul. 12, 2005

(54) FUEL CONDITIONING ASSEMBLY

(75) Inventors: Lee Ratner, deceased, late of Wellington, FL (US); by Joel S. Ratner, legal representative, Wellington, FL (US)

(73) Assignee: Royce Walker & Co., Ltd., Nassau (BH)

( * ) Notice: Subject to any disclaimer, the term of this patent is extended or adjusted under 35 U.S.C. 154(b) by 0 days.

(21) Appl. No.: 10/419,655

(22) Filed: Apr. 21, 2003

(65) Prior Publication Data

US 2003/0192514 A1 Oct. 16, 2003

Related U.S. Application Data

(63) Continuation-in-part of application No. 09/934,229, filed on Aug. 21, 2001, now Pat. No. 6,550,460, which is a continuation-in-part of application No. 09/557,705, filed on Apr. 25, 2000, now Pat. No. 6,276,346, which is a continuation-in-part of application No. 09/249,878, filed on Feb. 16, 1999, now Pat. No. 6,053,152, which is a continuation-in-part of application No. 08/782,348, filed on Jan. 13, 1997, now Pat. No. 5,871,000.

(51) Int. Cl.[7] ..... F02M 33/00
(52) U.S. Cl. ..... 123/538
(58) Field of Search ..... 123/536–538

(56) References Cited

U.S. PATENT DOCUMENTS

| | | | | |
|---|---|---|---|---|
| 2,033,753 A | | 3/1936 | Bucklen | |
| 2,231,605 A | | 2/1941 | Stephenson et al. | |
| 2,999,485 A | | 9/1961 | Lundy et al. | |
| 4,798,191 A | | 1/1989 | King | |
| 4,930,483 A | | 6/1990 | Jones | |
| 5,044,347 A | | 9/1991 | Ulrich et al. | |
| 5,069,190 A | | 12/1991 | Richards | |
| 5,069,191 A | | 12/1991 | Scouten | |
| 5,074,273 A | | 12/1991 | Brown | |
| 5,076,246 A | | 12/1991 | Onyszczuk | |
| 5,092,303 A | | 3/1992 | Brown | |
| 5,154,153 A | * | 10/1992 | MacGregor | 123/538 |
| 5,167,782 A | * | 12/1992 | Marlow | 204/168 |
| 5,197,446 A | | 3/1993 | Daywalt et al. | |
| 5,305,725 A | | 4/1994 | Marlow | |
| 5,307,779 A | | 5/1994 | Wood et al. | |
| 5,342,586 A | * | 8/1994 | Park | 422/211 |
| 5,393,723 A | | 2/1995 | Finkl | |
| 5,447,625 A | | 9/1995 | Roe | |
| 5,524,594 A | | 6/1996 | D'Alessandro | |
| 5,871,000 A | * | 2/1999 | Ratner | 123/538 |
| 5,881,702 A | | 3/1999 | Arkfeld | |
| 6,000,381 A | * | 12/1999 | Berlin et al. | 123/538 |
| 6,053,152 A | * | 4/2000 | Ratner | 123/538 |
| 6,276,346 B1 | * | 8/2001 | Ratner et al. | 123/538 |
| 6,306,185 B1 | | 10/2001 | Berlin et al. | |
| 6,550,460 B2 | * | 4/2003 | Ratner et al. | 123/538 |

* cited by examiner

*Primary Examiner*—Marguerite McMahon
(74) *Attorney, Agent, or Firm*—Malloy & Malloy, P.A.

(57) ABSTRACT

A fuel conditioning assembly, structured to be positioned between a fuel supply and a fuel combustion assembly, and including an elongate tubular housing having an inlet end, an outlet end, and a flow through passage extending there between. The inlet end is coupled with the fuel supply so as to receive fuel flow there through into the flow through passage, wherein a turbulent flow of the fuel is initiated and the fuel is influenced by a combination of elements, in compound or elemental form such as copper, aluminum, stainless steel, titanium, magnesium, barium, calcium, iron, zirconium, cerium, platinum, and/or palladium which chemically condition the fuel flowing through the flow through passage by rearranging the molecular bonds of the fuel with a catalytic effect. The fuel, regardless of its type is further dispersed into very small droplets having high surface areas thereby lowering the vapor density of the fuel and substantially increasing a fuel burn efficiency. Further, the outlet end of the housing is coupled directly with the fuel combustion assembly so as to provide for the flow of conditioned fuel there between without a substantial risk of a diminishing of the effects of the conditioning.

17 Claims, 3 Drawing Sheets

FUEL CONDITIONING ASSEMBLY

CLAIM OF PRIORITY

The present application is a Continuation-In-Part of U.S. patent application Ser. No. 09/934,229, filed on Aug. 21, 2001 now U.S. Pat. No. 6,550,460, which is a Continuation-In-Part application of Ser. No. 09/557,705 filed on Apr. 25, 2000, which matured into U.S. Pat. No. 6,276,346 on Aug. 21, 2001, which is a Continuation-In-Part application of Ser. No. 09/249,878 filed on Feb. 16, 1999, which matured into U.S. Pat. No. 6,053,152 on Apr. 25, 2000, which is a Continuation-In-Part of Ser. No. 08/782,348, filed Jan. 13, 1997, now U.S. Pat. No. 5,871,000 issued on Feb. 16, 1999, wherein all of the above are incorporated herein, in their entirety, by reference.

BACKGROUND OF THE INVENTION

1. Field of the Invention

The present invention relates to a fuel conditioning assembly for use in a fuel combustion system, which is substantially easy to install and maintenance free, and is structured to provide a more complete combustion of fuel, regardless of the type of fuel utilized, reduce the emission of pollutants, provide a cleaner running system, which requires less maintenance, and significantly increase fuel efficiency.

2. Description of the Related Art

The natural inefficiency inherent in internal combustion engines is well documented. Specifically, internal combustion engines utilizing fossil fuels typically emit unburned or under-burned fuel from the exhaust as well as the undesirable by-products of combustion. This under-burning of fuel causes severe environmental problems as the resultant pollutants, some of which are thought to be cancer causing, are emitted directly into the atmosphere. In addition to being emitted directly into the atmosphere through the exhaust, many by-products of fuel combustion simply accumulate on internal engine components, with often 30% of the exhaust being directed into the engine. This causes those engine components to wear out sooner and require frequent maintenance and repairs which can lead to shortened total engine life. Furthermore, the incomplete combustion of fuel within an engine substantially under-utilizes the energy capacity of the fuel. Specifically, in addition to the environmental concerns due to pollution attributed to the under-utilization of the energy capacity of fuel, there are also resultant losses in economic efficiency due to higher fuel and maintenance expenses as well as a generally shorter engine life.

Others in the art have developed various fuel conditioning assemblies in an attempt to alleviate some of the above-mentioned problems. For example, in the past various types of heating devices were incorporated into a fuel conditioning assembly so as to raise the temperature of the fuel and thereby improve the combustion properties of the fuel. Specifically, such devices include a heating element which comes into contact with the fuel so as to raise it's temperature and consequently reduce the density of the fuel. Of course, such a procedure can also raise the engine temperature and can prove quite hazardous. Additionally, others in the art have attempted to add various types of additives to the fuel in an attempt to positively effectuate improvement in the fuel's combustion properties. Such additives have included the addition of minute quantities of Cupric salts, for example, to the fuel supply. Unfortunately, however, it can be difficult to obtain and consistently add those additives in an efficient manner. Also, if the additives are not completely soluble in the fuel, they may be quite harmful to the engine.

Accordingly, none of these devices have actually been successfully and practically incorporated with a combustion engine in a simple, economical, and maintenance free manner.

In addition to the above-referenced approaches, others in the art have sought to introduce various metals, in combination, within a flow of fuel in an attempt to generate a chemical reaction which effects the combustion properties of the fuel. Although some of these devices do improve the combustion properties of the fuel somewhat, those skilled in the art have not been successful in substantially increasing the combustion properties in a practical and effective manner. In particular, such devices have been unable to effectuate a substantial improvement such as would be necessary to offset the price of purchase and installation of the device into existing engines. Indeed, the improved combustion properties provided by existing fuel conditioning assemblies are so slight that a user may find it more economical to increase the combustion properties of the fuel simply by switching to a higher octane rated fuel or by mixing the fuel with an additive.

Accordingly, there is still a need in the art for a practical and cost-effective fuel conditioning assembly which reduces visible smoke as well as other pollutants being discharged through the exhaust, increases fuel efficiency (as quantified in miles per gallon), provides for a cleaner running engine requiring less maintenance, extends the useful life of engine components, is substantially maintenance free, and is substantially easy and safe to implement with existing engine designs. Furthermore, such a fuel conditioning system should be effectively employable in other combustion systems and applications, such as a fuel burning furnace, wherein the efficiency and nature of the combustion is significant for the ultimate output to be achieved.

SUMMARY OF THE INVENTION

The present invention is directed towards a fuel conditioning assembly that is structured to be positioned between a fuel supply and a fuel combustion assembly. In particular, the fuel conditioning assembly of the present invention includes a preferably rigid housing having an inlet end, an outlet end, and a flow through passage extending from the inlet end to the outlet end.

Moreover, the fuel conditioning assembly is disposed inside the flow through passage and is structured to chemically condition the fuel as it travels through the flow through passage. At least one preferred embodiment of the conditioning assembly of the present invention is structured to rearrange the molecular bonds of the fuel with a catalytic effect and separate the fuel particles into a plurality of subatomic particles, thereby reducing the density of the fuel and substantially increasing a fuel burn efficiency. As used herein, the term subatomic particles is intended to describe the atomization of the fuel, which leads to turbulence and the subsequent formation of separated molecules of fuel with a lower vapor density resulting in better combustion. Further, the construction and resulting performance characteristics of at least one preferred embodiment of the present invention results in an "atomization" or dispersion of any of a variety of fuels which may be utilized when practicing the present invention. As set forth in greater detail herein the fuel may include, but not be limited to, gasoline, diesel, bio-diesel, etc. As a result of the aforementioned atomization or dispersion, the fuel is transformed into small droplets having a high surface area thereby lowering the fuel vapor density and increasing the completeness of fuel combustion.

The inlet end of the housing is coupled with the fuel supply so as to receive fuel there through into the flow through passage. As such, a generally continuous flow of fuel passes into the housing when the fuel system is operational. Similarly, the outlet end of the housing is coupled with the fuel combustion assembly so as to receive the flow of conditioned fuel exiting the housing. As also described in greater detail hereinafter structural features of the housing, in at least one preferred embodiment thereof, may include a screen structure formed of a stainless steel, aluminum composite or other predetermined material. The screen is disposed in interruptive relation with the flow of fuel through the housing and is structured to produce additional turbulent mixing of the fuel. As a result, the treated fuel mixture has a lowered fuel vapor density, as set forth above, which further facilitates a more efficient burn of the fuel.

Therefore, it is an object of the present invention to provide a fuel conditioning assembly which rearranges the molecular bonds of a fuel with a catalytic effect and separates fuel particles into a plurality of subatomic particles so as to reduce the density of the fuel and thereby increase the completeness of a burn of the fuel. Again for purposes of clarity and emphasis, subatomic particles is a term used to describe the atomization of the fuel which leads to its turbulence and subsequent formation of separated molecules of fuel with a lower vapor density, resulting in better combustion.

A further object of the present invention is to provide a fuel conditioning assembly which provides for more complete combustion of fuel and thereby reduces the emission of fuel from the exhaust as well as the emission of smoke, fumes, etc, as part of the exhaust.

Another object of the present invention is to provide a fuel conditioning assembly which provides for more complete combustion and cleaner burning of fuel so as to provide a cleaner running engine requiring less maintenance.

An additional object of the present invention is to provide a fuel conditioning assembly which increases the fuel efficiency of a vehicle, as measured in miles per gallon, for example.

It is a further object of the present invention to provide a fuel conditioning assembly which is substantially rugged and durable for heavy duty use and does not contain any moving parts or electrical connections which can be damaged or wear out over time.

It is also an object of the present invention to provide a fuel conditioning assembly which is substantially maintenance free.

Yet another object of the present invention is to provide a fuel conditioning system which recognizes and utilizes an ideal combination of elements in order to maximize the effectiveness of the chemical reaction which conditions the fuel.

These and other objects, features, and advantages of the present invention will become more readily apparent from the attached drawings and the detailed description of the preferred embodiments, which follows:

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout the figures, the present invention is directed towards a fuel conditioning assembly, generally indicated as 10. The fuel conditioning assembly 10 is structured to be connected in line with an engine or other combustion based system's fuel system in order to effectively treat and condition the fuel prior to its combustion therein, thereby ensuring that a more effective, more efficient burn is achieved.

Figure 2:
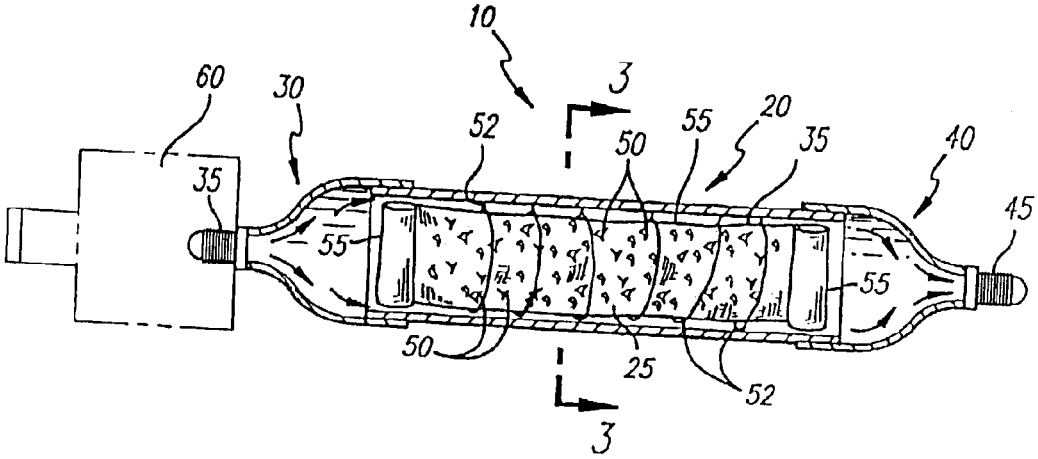
FIG. 2 is a cross-sectional side view of a first embodiment of the fuel conditioning assembly.
Figure 3:
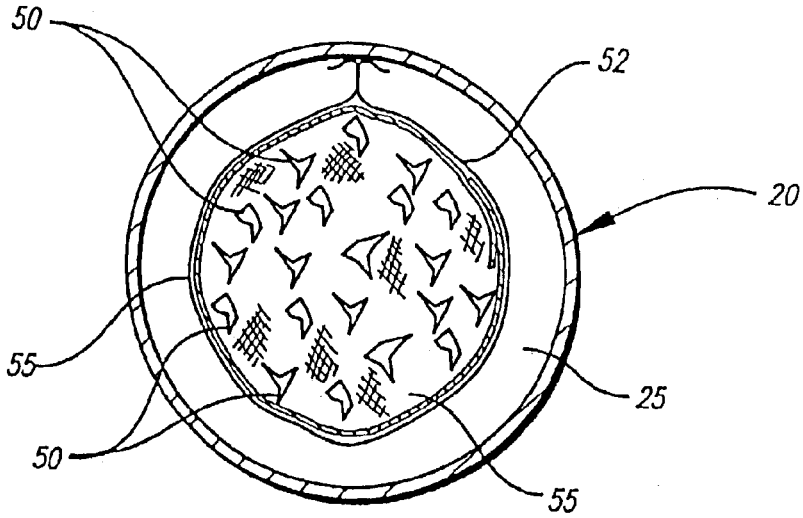
FIG. 3 is a cross-sectional view taken along line 3—3 of FIG. 2.

In particular, the fuel conditioning assembly 10 includes a housing 20, as shown in the figures. The housing 20, which includes an inlet end 30, an outlet end 40, is preferably rigid in construction, and includes a generally tubular configuration. The inlet and outlet ends 30 and 40 may be defined by separate elements fitted onto a main body, or a single cast element generally defining the entire housing 20 may be utilized. Moreover, extending from the inlet end 30 of the housing to its outlet end 40 is a flow through passage 25, as best shown in FIGS. 2 and 3. As such, fuel is able to pass through the housing 20 where it can be effectively conditioned as a result of the present invention. In one preferred embodiment, the housing 20 is formed of Copper, for reasons to be described subsequently. However, other, preferably rigid, materials including metal and/or plastic materials may also be utilized effectively.

Figure 1:
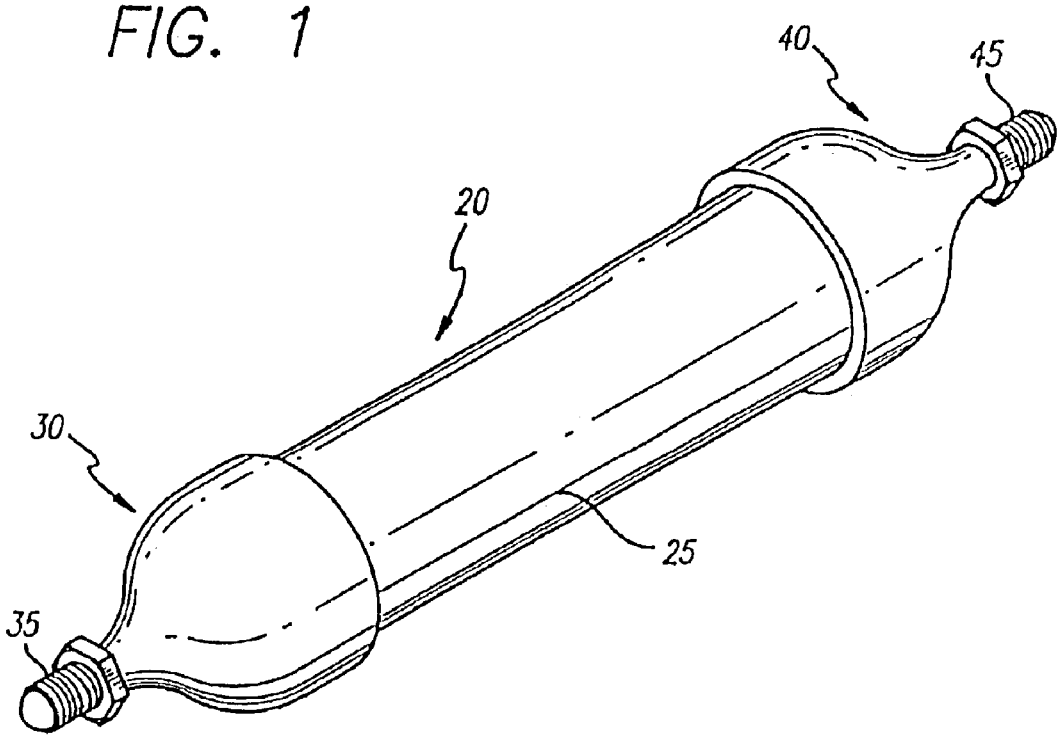
FIG. 1 is a perspective view of the fuel conditioning assembly.

Furthermore, the housing 20 preferably includes a generally elongate tubular configuration, as shown in FIGS. 1 and 2, 50 as to facilitate a desired residence time in which the fuel is within the flow through passage 25 of the housing 20 and is being conditioned. Of course, the length of the housing 20 may be altered to suit particular situations in which more or less conditioning is desired, and also so as to accommodate the capacity and size requirements of specific engine types and combustion systems. For example, by increasing the length of the housing 20, and therefore the flow through passage 25, the average residence time of a given quantity of fuel is increased and the fuel conditioning reaction which takes place is maximized.

Looking specifically to the inlet end 30 of the housing 20, it is coupled, either directly or indirectly, with a fuel supply of the engine or other combustion system. As such, the inlet end 30 of the housing 20 receives a consistent flow of fuel there through, wherein the fuel is directed into the flow through passage 25 during normal operation of the combustion fuel system. In order to facilitate a substantially tight and leak-proof connection with the fuel supply, the inlet end 30 is preferably outfitted with an inlet nozzle member 35. The inlet nozzle member 35 will preferably be threaded so as to securely, yet removably, engage a fuel line of the fuel supply of the engine. As such the fuel line may be removably secured to the housing 20 and define a substantially tight, fluid impervious connection with the inlet end 30.

In at least one preferred embodiment of the present invention, the inlet nozzle member 35 is snap-fitted onto the housing 20. However, other means of securing the inlet nozzle member 35 to the housing 20 may be utilized without departing from the intended scope of the present invention. Alternatively, the inlet portion 30 may be integrally formed on the housing 20, in communication with the flow through passage 25, or otherwise permanently secured thereto. Furthermore, the inlet end 30 of the housing 20 is preferably structured to permit fuel to flow into and through the flow through passage 25 of the housing 20 at an inlet pressure of between 40 and 60 psi, thereby maintaining a consistent and sufficient flow of fuel therethrough for use in the combustion process. Additionally, in one preferred embodiment, a fuel filter 60 is provided and coupled in fluid flow communication with the inlet end 30 of the housing 20, as shown in FIG. 2. As such, prior to the entry of the fuel into the housing 20, where it will be conditioned, the fuel is filtered to remove a variety of particle impurities.

Looking now to the outlet end 40 of the housing 20, it is coupled with the fuel combustion assembly (not shown for purposes clarity) of the engine or other combustion system so as to provide for the flow of conditioned fuel thereto for its subsequent combustion. Like the inlet end 30, the outlet end 40 can be removably secured to the flow through passage 25 of the housing 20. Moreover, an outlet nozzle member 45 may be provided so as to further define the outlet end 40 of the housing 20. The outlet nozzle member 45 is preferably secured to the housing 20 by a substantially tight and leak-proof connection similar to the snap-fit connection preferably utilized in securing the inlet nozzle member 35 of the inlet end 30 to the housing 20. Alternatively, however, the outlet end 40 may be integrally formed with the housing 20 in communication with the flow through passage 25, and/or be otherwise permanently secured thereto. In the preferred embodiment, the outlet nozzle member 45 of the outlet end 40 is externally threaded and is structured to be coupled in direct fluid flow communication with the fuel combustion assembly by a segment of tubing, thereby assuring that the conditioned fuel is combusted substantially in a conditioned state and does not have sufficient time to begin to return to a normal un-conditioned state. Indeed, a separation of only approximately six inches is preferred.

The fuel conditioning assembly 10 further includes a conditioning assembly. Specifically, the conditioning assembly is disposed within the flow through passage 25 and is structured to at least temporarily chemically condition the fuel flowing through the flow through passage 25. In particular, the conditioning assembly is structured and disposed so as to rearrange the molecular bonds of the fuel with a catalytic effect, and separate the fuel particles into a plurality of subatomic particles. The term subatomic particles, as used herein, is meant to describe the atomization of the fuel, which leads to its turbulence and subsequent formation of separated molecules of fuel with a lower vapor density and a better combustion. Therefore, as a result of this conditioning of the fuel, the fuel's density is reduced and the burning efficiency of the fuel is substantially increased. More particularly, as the fuel is treated by the conditioning assembly during its passage through the housing 20 the less dense, more dispersed fuel is able to more completely burn, as a majority of the fuel molecules are subjected to the combustion reaction. As a result of a more complete burn of the conditioned fuel, energy output and efficiency is increased prior to exhaust. More specifically, conditioning of the fuel in accordance with the present invention, has the two-fold effect of increasing the energy that results from the burn, thereby increasing the fuel efficiency, and reducing the harmful particulate materials or other contaminants that are normally present in the exhaust emissions. Therefore, the combustion system operates on a cleaner basis and is maintained in operating condition longer, while reducing the environmental pollutants present in the exhaust fumes.

In particular, the conditioning assembly preferably includes a turbulence assembly, which is structured to create a turbulent flow of the fuel within the flow through passage 25. The turbulence assembly is structured to substantially agitate the fuel flowing through the flow through passage 25 and thereby substantially enhance the effects of the conditioning by ensuring that the fuel particulate are substantially dispersed and are fully influenced by the conditioning elements present within the flow through passage 25 and responsible for the conditioning to be achieved. In the preferred embodiment, the turbulence assembly includes a plurality of particulate disposed within the flow through passage 25 and structured to create turbulence in the fuel as it flows there through from the inlet end 30 to the outlet end 40 of the housing 20, as best shown in FIG. 2. Moreover, it is preferred that the plurality of particulate include metal shavings 50. Specifically, the entangled, random and dense configuration of an agglomeration of metallic shavings achieves a maximum turbulent effect as the fuel is pushed there through and is continuously re-routed. In the preferred embodiment, the plurality of metal shavings 50 are formed of stainless steel. Moreover, in one preferred embodiment, the metal shavings 50 are enclosed within mesh or screen 55, as best shown in FIGS. 2 and 3.

Specifically, the mesh 55 is structured in a generally net-like configuration so that it effectively retains the metal shavings 50 therein and provides a substantially large surface area for contacting the fuel. Moreover, the mesh 55 is oriented inside the housing 20 so as to permit the fuel to flow freely there through, and through the plurality of metal shavings 50, without allowing any of the metal shavings 50 to exit the housing 20 with the conditioned fuel. In the preferred embodiment, the mesh 55 is formed of Aluminum, although other materials may also be utilized. In the illustrated embodiment, a plurality of wire loops 52 or like fasteners are disposed with the mesh 55, so as to facilitate conditioning and turbulence of the fuel as well as help keep the mesh 55 disposed around the metal shavings 55.

In addition to the turbulence assembly, the conditioning assembly further includes a plurality of metallic elements structured to come into contact with the turbulent flow of fuel through the flow through passage 25 of the housing 20 and cause a catalytic effect in the fuel flow. In particular, the metallic elements of the preferred embodiment which cause the catalytic effect include copper, aluminum and stainless steel, which when all are present and come into contact with a flow of fuel, and preferably a turbulent flow of fuel, initiate the aforementioned chemical conditioning and catalytic reaction that effectuates the conditioning of the fuel. Unlike alternative combinations of elements, these specific preferred elements, present so as to influence the fuel flow, provide significantly enhanced and unexpected results in the extent to which the chemical composition of the fuel is modified and enhanced. Furthermore, these particular metallic elements could be incorporated into the assembly 10 of the present invention in a variety of manners, such as by providing a plurality of differing metal shavings formed of the various metallic elements.

Also, as will be described hereinafter with regard to the embodiment of FIG. 4, one preferred embodiment the various components of the fuel conditioning assembly 10 are formed such that the necessary combination of metallic elements are disposed to influence the fuel. In particular, in one preferred embodiment, all or part of the housing 20 is formed of copper such that as the fuel flows through the flow through passage 25 it contacts the housing and is influenced by the copper composition thereof. Moreover, the metallic shavings 50, in this preferred embodiment, are stainless steel metal shavings. As a result, as the fuel flows in its turbulent fashion through the metal shavings 50, it comes into contact with the shavings 50 and is influenced by the stainless steel composition thereof. Also, in one preferred embodiment, the mesh 55 is formed of aluminum. Accordingly, as the fuel flows through the mesh 55 and into the metal shavings 50, it comes into contact with the aluminum composition of the mesh 55 and is influenced thereby. It is the influence of that combination of elements, in the preferred embodiment, that substantially leads to the enhanced chemical and catalytic reaction which conditions the fuel.

Figure 4:
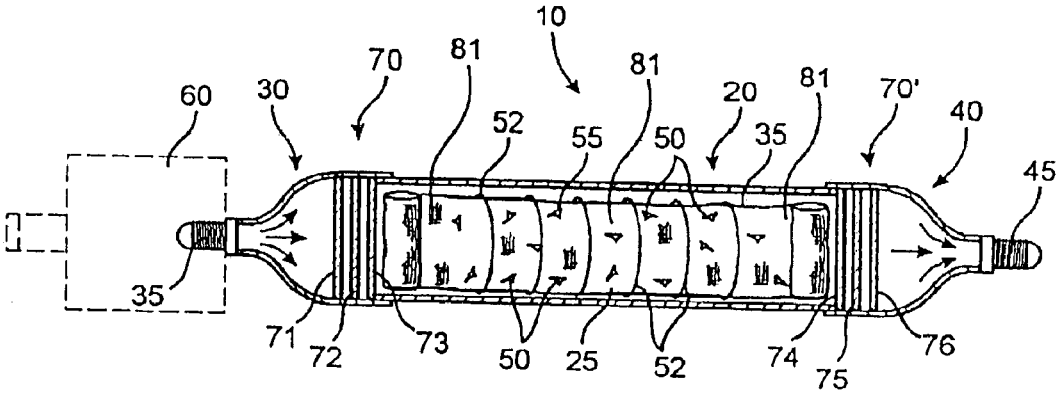
FIG. 4 is a cross-sectional side view of another embodiment of the fuel conditioning assembly.

Turning to FIG. 4, in yet another preferred embodiment at least one, but preferably a plurality of screen elements 70, 70' are provided in operative association with the housing 20. Preferably, the screen elements 70, 70' are disposed at both the inlet end 30 and the outlet end 40 of the housing 20 so as to define inlet screen elements 70 and outlet screen elements 70'. As such, the fuel flow into and out of the housing 20 must necessarily pass through the screens 70 and 70'. Screens 70 and 70' could be formed of a material which does not cause a catalytic effect but merely filters the fuel. However, in the preferred embodiment of FIG. 4, at least one and preferably both the inlet and outlet screen elements 70, 70' at least partially comprise and thereby define a part of the conditioning assembly.

In addition, it is preferred that at least three screen elements are associated with each of the inlet and outlet screen elements 70 and 70'. As represented, each of the screen elements 71, 72, 73 and 74, 75, 76, which respectively comprise the inlet and outlet screen elements 70 and 70' are preferably formed of a different one of the metallic elements which cause the catalytic effect. Such elements include copper, aluminum, and stainless steel. For example, it is preferred that three screen elements 71, 72 and 73 comprise the inlet screen elements 70 and be formed of a different material from one another, while three screen elements 74, 75, and 76 formed of different materials from one another define the outlet screen elements 70'. As a result the catalytic effect in the fuel, and therefore the fuel conditioning, if not entirely achieved at the inlet end 30 of the housing 20, can be further enhanced at the outlet end 40 of the housing 20.

Of course, other embodiments of the present invention comprise the turbulence assembly and other elements within the housing 20 being formed of other metallic or non-metallic materials, with the copper, aluminum, and stainless steel elements being the primary elements that treat the fuel by causing a catalytic effect. As a result, other treatment elements may be provided for alternative or additional treatment of the fuel in other or increased ways, or other material elements used merely to generate turbulence and define the various components of the housing 20 may be included.

Accordingly, the structural features of the turbulence assembly particularly, but not exclusively, including the inlet and outlet screen elements 70 and 70' additionally serve to create an "atomization" and dispersion of the fuel, regardless of its category. Such atomization, caused by the additional turbulence, results in the fuel being dispersed into small droplets having high surface areas. This additional turbulent mixing of the fuel produces a lowered fuel vapor density thereby providing a more complete combustion. As indicated above, a more complete combustion of the fuel prior to exhaust reduces the formation of contaminants in the exhaust and aids in a reduction of toxic, volatile organic compounds (VOC) such as, but not necessarily limited to benzene, toluene, xylene acetone, etc. Such VOC materials are of course recognized as typical byproducts of fuel combustion.

In yet another embodiment of the present invention, the elements that come into contact with the fuel and thereby cause a catalytic effect may include any combination of the elements: copper, aluminum, stainless steel, titanium, magnesium, barium, calcium, iron, Cerium, Lanthanum, Zirconium platinum and/or palladium. As such, one or more of the above elements may define the screens, the metal shavings, the housing, the mesh, the wires, welds, etc., so long as conditioning contact with the fuel is at least minimally achieved. For example, looking further to FIG. 4, one or more pellets 81 are defined within the flow through passage. These pellets 81 may be between 1 to 4 ounces in size, and between three to five pellets may be disposed at each end of the flow through passage, generally near the inlet and outlet ends, and possibly in the middle of the flow through passage. In this regard, however, it is recognized that larger, smaller, fewer number or greater number of pellets 81 may be employed and/or spaced throughout the flow through passage 25 so long as sufficient quantities of the elements are present to react with the fuel.

By way of further example, in the illustrated embodiment of FIG. 4, the screens 71, 72, 73 are formed from the copper, aluminum, stainless steel. As a result, one or more of the remaining elements, namely titanium, magnesium, barium, calcium, iron, Cerium, Lanthanum, Zirconium, platinum and/or palladium may define secondary elements that comprise the pellets and/or remaining structural aspects of the assembly 10. Of course, some interchangeability of the elements between the various components, and/or combinations of elements within a certain component, such as each pellet 81, are also considered to be included within the intended scope of the present invention.

Since many modifications, variations, and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents.

Now that the invention has been described,

What is claimed is:

1. A fuel conditioning assembly comprising:

a housing, said housing including an inlet end, an outlet end, and a flow through passage;

said inlet end being coupled with a fuel supply so as to receive fuel flow there through into said flow through passage;

a plurality of metallic elements structured to come into contact with said fuel flow and cause a catalytic effect in said fuel flow so as to at least temporarily condition the fuel and substantially increase a fuel burn efficiency thereof;

said metallic elements which cause said catalytic effect including at least two selected from the group consisting of: copper, aluminum, stainless steel, titanium, magnesium, barium, calcium, iron, cerium, lanthanum, zirconium, platinum and/or palladium;

at least three screen elements each being formed of a different one of said metallic elements which cause said catalytic effect, and at least one screen element disposed in covering relation to at least the inlet end of said housing and being structured to receive said fuel flow therethrough for passage into said flow through passage.

2. A fuel conditioning assembly as recited in claim 1 wherein said metallic elements which cause said catalytic effect include at least three selected from the group consisting of: copper, aluminum, stainless steel, titanium, magnesium, barium, calcium, iron, cerium, lanthanum, zirconium, platinum and/or palladium.

3. A fuel conditioning assembly as recited in claim 1 further comprising at least one screen element disposed in line with said fuel flow through said flow through passage of said housing.

4. A fuel conditioning assembly as recited in claim 3 comprising at least three screen elements, each of said screen elements being formed of a different one of said metallic elements which cause said catalytic effect.

5. A fuel conditioning assembly as recited in claim 1 further including a turbulence assembly structured and disposed to create a turbulent flow of the fuel through said flow through passage.

6. A fuel conditioning assembly as recited in claim 1 wherein at least some of said metallic elements are formed into at least one pellet disposed in said flow through passage.

7. A fuel conditioning assembly as recited in claim 6 including a plurality of said pellets disposed generally at said inlet end and said outlet end.

8. A fuel conditioning assembly comprising:

a housing, said housing including an inlet end, an outlet end, and a flow through passage;

said inlet end being coupled with a fuel supply so as to receive fuel flow there through into said flow through passage;

a plurality of metallic elements structured to come into contact with said fuel flow and cause a catalytic effect in said fuel flow so as to at least temporarily condition the fuel and substantially increase a fuel burn efficiency thereof; and said metallic elements which cause said catalytic effect including copper, aluminum, stainless steel, and at least one secondary element selected from the group consisting of: titanium, magnesium, barium, calcium, iron, cerium, lanthanum, zirconium platinum and/or palladium.

9. A fuel conditioning assembly as recited in claim 8 wherein said secondary element is disposed in said flow through passage.

10. A fuel conditioning assembly as recited in claim 9 wherein said secondary element is formed into at least one pellet disposed in said flow through passage.

11. A fuel conditioning assembly as recited in claim 10 wherein said pellet is generally between about 1 to 4 ounces.

12. A fuel conditioning assembly as recited in claim 10 including a plurality of said pellets disposed generally at said inlet end and said outlet end.

13. A fuel conditioning assembly as recited in claim 12 including generally between 3 to 5 of said pellets.

14. A fuel conditioning assembly as recited in claim 8, comprising at least three screen elements, each of said screen elements being formed of a different one of said metallic elements which cause said catalytic effect.

15. A fuel conditioning assembly comprising:

a housing including an inlet end, an outlet end and a flow through passage;

said inlet end being coupled with a fuel supply so as to receive fuel flow therethrough into said flow through passage;

a plurality of metallic elements structured to come into contact with said fuel flow and cause a catalytic effect in said fuel flow so as to at least temporarily condition the fuel and substantially increase a fuel burn efficiency thereof;

said metallic elements which cause said catalytic effect including at least two selected from the group consisting of copper, aluminum, stainless steel, titanium, magnesium, barium, calcium, iron, cerium, lanthanum, zirconium, platinum and/or palladium, at least three inlet screen elements disposed in covering relation to at least said inlet end of said housing, said inlet screen elements being structured to receive said fuel flow therethrough for passage into said flow through passage; and at least three outlet screen elements disposed in covering relation to at least said outlet end of said housing, said outlet screen elements being structured to receive said fuel flow therethrough for passage out of said flow through passage.

16. A fuel conditioning assembly as recited in claim 15 wherein each of said inlet screen elements is formed of a different one of said metallic elements which cause said catalytic effect.

17. A fuel conditioning assembly as recited in claim 16 wherein each of said outlet screen elements is formed of a different one of said metallic elements which cause said catalytic effect.

* * * * *